US008808466B2

(12) United States Patent
Bertsch et al.

(10) Patent No.: US 8,808,466 B2
(45) Date of Patent: Aug. 19, 2014

(54) DISHWASHER DETERGENT DISPENSER

(75) Inventors: Roger J. Bertsch, Stevensville, MI (US); Timothy D. Lee, Kalamazoo, MI (US); Antony M. Rappette, Benton Harbor, MI (US); Syed R. Raza, Portage, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 946 days.

(21) Appl. No.: 12/903,255

(22) Filed: Oct. 13, 2010

(65) Prior Publication Data

US 2012/0090643 A1 Apr. 19, 2012

(51) Int. Cl.
*A47L 15/44* (2006.01)

(52) U.S. Cl.
USPC ..... 134/56 D; 134/93

(58) Field of Classification Search
CPC . A47L 15/44; A47L 15/4409; A47L 15/4418; A47L 15/4436
USPC ..... 134/57 D, 57 DL, 56 D, 58 D, 58 DL, 93; 222/651
See application file for complete search history.

(56) References Cited

U.S. PATENT DOCUMENTS 5,186,912 A * 2/1993 Steindorf et al. ..... 422/263
5,884,821 A * 3/1999 Wilhelmstaetter et al. ... 222/511
6,622,892 B2 * 9/2003 Vance ..... 222/143
7,146,992 B2 12/2006 Elick et al.
7,207,341 B2 4/2007 Cantave et al.
7,506,656 B2 * 3/2009 Cerruti ..... 134/99.2
8,608,866 B2 * 12/2013 Francisco et al. ..... 134/56 D
2005/0039781 A1 * 2/2005 Song et al. ..... 134/43
2007/0246070 A1 10/2007 Gunnerson et al.
2009/0235959 A1 * 9/2009 Gibis et al. ..... 134/93

FOREIGN PATENT DOCUMENTS

EP 0893091 B1 9/2004
EP 1847211 A1 * 10/2007
GB 2215992 A 4/1989

* cited by examiner

*Primary Examiner* — Joseph L Perrin
*Assistant Examiner* — Kevin G Lee

(57) ABSTRACT

In a dishwasher having a washing chamber capable of accommodating kitchenware for washing, a detergent dispenser includes a housing defining a chamber for receiving detergent. A lid is pivotally connected to the housing for selectively pivoting between a closed position for sealing the detergent chamber and an open position which permits washing fluid to enter the detergent chamber in connection with dispensing of detergent. The detergent chamber is provided with at least one washout port enabling washing fluid to enter the chamber, even if the lid can only pivot through a limited range to a partial open position due to an obstruction. A raised shield guard, which is spaced from the lid, extends in front of the lid to ensure that a potentially obstructing object within the washing chamber does not prevent the lid from moving to at least the partial open position during a wash cycle.

20 Claims, 4 Drawing Sheets

DISHWASHER DETERGENT DISPENSER

BACKGROUND OF THE INVENTION

1. Field of the Invention

The present invention pertains to the art of dishwashers and, more particularly, to a detergent dispenser for a dishwasher.

2. Description of the Related Art

Many dishwashers include a dispenser having a lid that swings open to release detergent at a specific time during a dishwasher cycle. The dispenser is often located on an interior side of a dishwasher door. While this position allows for convenient filling of the dispenser, large objects within the dishwasher may obstruct the opening of the dispenser lid. For example, if a utensil positioned in a silverware basket of the dishwasher is pressed against the dispenser door when it is set to open, the detergent will not be released such that the dishes will not be adequately cleaned.

To address this obstruction problem, it has been proposed to incorporate a lid shield into a dishwasher detergent dispenser to enable the dispenser lid to open even when an object is located in its path of movement. In particular, U.S. Pat. No. 7,207,341 discloses a dishwasher detergent dispenser including a shield extending in front of a pivoting dispenser lid to ensure that an object within the washing chamber does not prevent the lid from freely moving from a closed position covering a detergent chamber to a dispensing position during a wash cycle. To accomplish this function, the shield includes a cross member and side legs which themselves are mounted for pivotal movement relative to a dispenser housing. With this arrangement, the dispenser lid can pivot, through a limited angular range, relative to the shield and then pivot further in unison with the shield. Unfortunately, this configuration still mandates a rather large angular movement of the lid to expose the detergent chamber and enable the pre-loaded detergent to be washed into a tub of the dishwasher. In addition, the structure and mounting of the shield of this prior art results in a rather elaborate and costly production configuration.

Based on the above, there exists a need to for a dishwasher detergent dispenser which is constructed in a manner which will assure that loaded detergent will be properly and timely dispensed during a washing operation, even when the dispenser lid is obstructed from even partially opening by an object within the washing chamber of the dishwasher.

SUMMARY OF THE INVENTION

In general, the present invention is directed to a dishwasher capable of accommodating various kitchen items, such as on one or more racks provided within a washing chamber, for a washing operation, as well as a dispenser assembly including a housing defining a compartment for receiving detergent to be timely dispensed during the washing operation. A lid is connected to the housing for movement between a closed position in which the detergent compartment is covered, and a dispensing position in which the detergent compartment is exposed. The lid is preferably biased open and retained in the closed position through a releasable latch. Under normal operating conditions, the lid is not obstructed from opening. In accordance with the invention, the dispenser assembly is specifically constructed to assure that, even in the event that the lid is obstructed from fully opening for a dispensing operation, such as by tall utensils placed in a silverware basket within the washing chamber becoming lodged directly in front of the lid so as to obstruct free movement of the lid, the lid can still open to at least partially expose the detergent compartment to a flow of liquid, thereby enabling supplied detergent to be washed out of the detergent compartment.

More particularly, in accordance with a preferred form of the invention, the above objects are achieved by specifically forming the detergent compartment with at least one side wall including one or more washout ports enabling an inflow of washing liquid into the detergent compartment which, in turn, causes detergent to be washed from the detergent compartment even upon only a partial opening of the lid. Further, a shield extends in front of the lid to ensure that the lid will not be prevented from at least assuming a partially open position, even when the lid is obstructed from assuming its fully open position.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Figure 1:
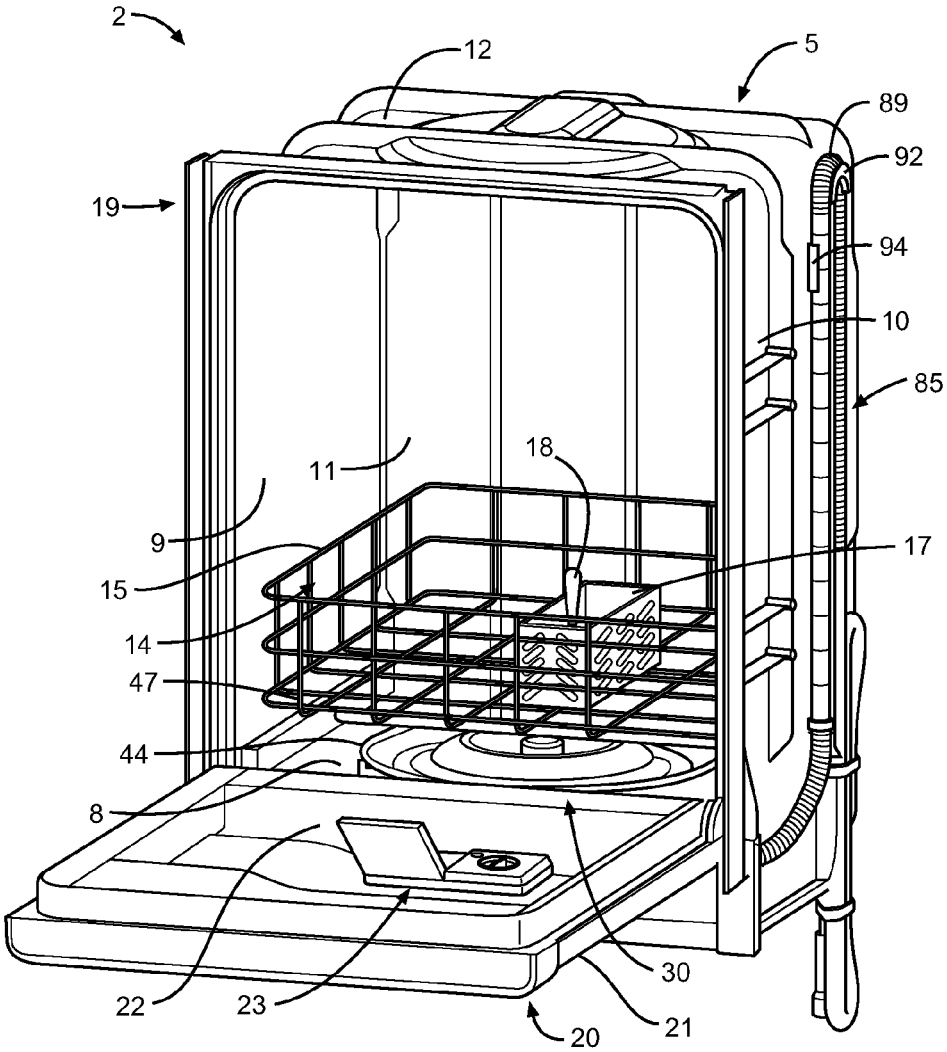
FIG. 1 is a perspective view of a dishwasher incorporating a detergent dispenser constructed in accordance with the present invention, with a lid of the detergent dispenser being shown between fully open and fully closed positions.

With initial reference to FIG. 1, a dishwasher employed in connection with the present invention as generally indicated at 2. As shown, dishwasher 2 includes a tub 5 which is preferably injection molded of plastic so as to include integral bottom, side, rear and top walls 8-12 respectively. Within the confines of walls 8-12, tub 5 defines a washing chamber 14 within which soiled kitchenware is adapted to be placed upon shiftable upper and lower racks (the lower rack being indicated at 15), with the kitchenware being cleaned during a washing operation in a manner widely known in the art. As shown in this figure, a utensil basket 17, which contains a utensil 18, is preferably positioned within lower rack 15. Tub 5 has associated therewith a frontal portion 19 at which is pivotally supported a door 20 used to seal chamber 14 during a washing operation. Door 20 has an exterior panel 21 and an interior panel 22 preferably provided with a detergent dispenser 23 within which a consumer can place liquid or particulate washing detergent for dispensing at predetermined periods of the washing operation.

Disposed within tub 5 and, more specifically, mounted within a central opening formed in bottom wall 8 of tub 5, is a pump and filter assembly 30. Extending about a substantial portion of pump and filter assembly 30, at a position raised above bottom wall 8, is a heating element 44. In a manner known in the art, heating element 44 preferably takes the form of a sheath, electric resistance-type heating element. In general, pump and filter assembly 30 is adapted to direct washing fluid to a lower wash arm 47 and an upper wash arm (not shown). Dishwasher 2 has associated therewith a drain hose 85 including at least one corrugated or otherwise curved portion 89 that extends about an arcuate hanger 92 provided on an outside surface of side wall 10. Drain hose 85 is also preferably secured to tub 5 through various clips, such as that indicated at 94. In any event, in this manner, an upper loop is maintained in drain hose 85 to assure proper drainage in a manner known in the art. Actually, a detailed description of the exact structure and operation of pump and filter assembly 30 of dishwasher 2 does not form part of the present invention, but is rather set forth in U.S. Pat. No. 7,146,992 entitled "Dishwasher Pump and Filtration System", incorporated herein by reference.

At this point it should be realized that the particular construction and washing cycle operation of dishwasher 2 can greatly vary in accordance with the invention. Therefore, the type of dishwasher construction depicted in this figure is provided for exemplary purposes only such that the invention can be used on various dishwasher models, including drawer dishwashers. In connection with the embodiment shown in FIG. 1, detergent dispenser 23 is actually located on interior panel 22 in a position so as to be generally adjacent to utensil basket 17 when door 20 is in a closed position. Based on this arrangement, it is possible that utensil 18 within utensil basket 17, or perhaps other kitchenware items such as pots, a cookie sheet/baking pans or the like placed in rack 15, may interfere with the desired operation of detergent dispenser 23. To address this concern, the present invention is actually directed to the construction and operation of detergent dispenser 23 of dishwasher 2 as will be detailed below.

Figure 2:
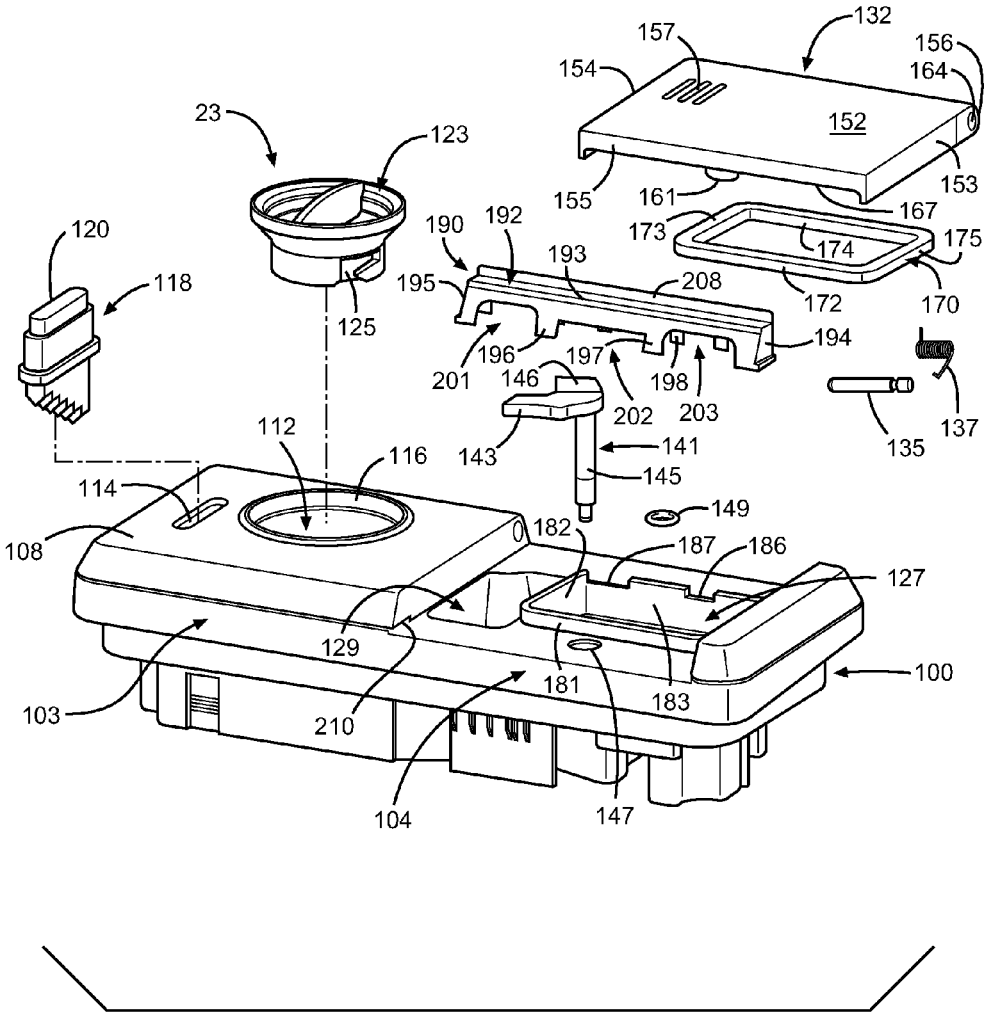
FIG. 2 is an exploded view of a detergent dispenser constructed in accordance with a first embodiment of the invention.
Figure 3:
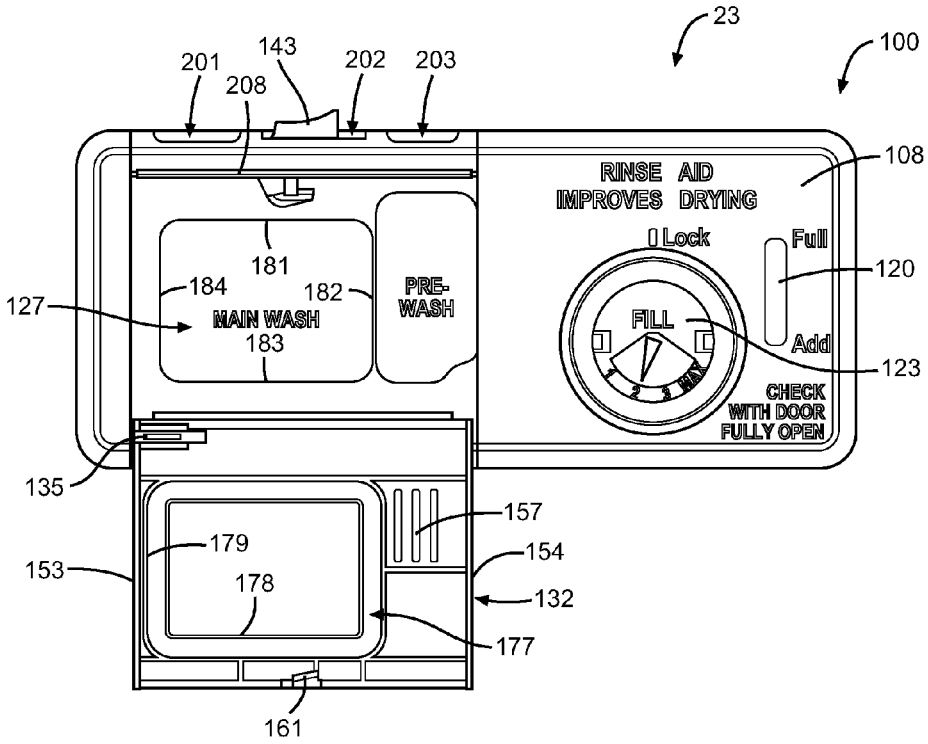
FIG. 3 is a front plan view of the detergent dispenser of FIG. 2, with the lid thereof shown in an open position.
Figure 4:
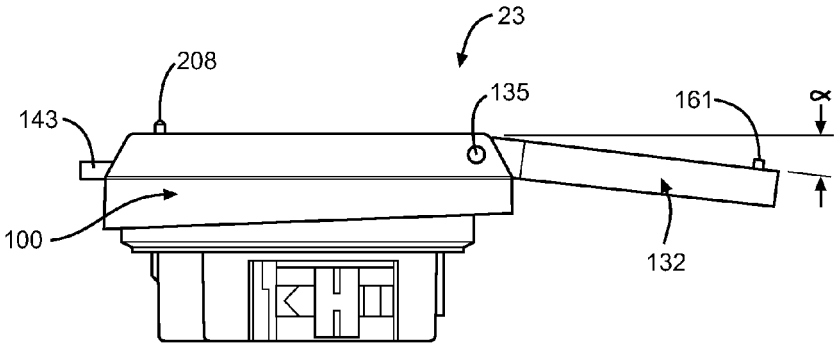
FIG. 4 is a side view of the detergent dispenser of FIG. 3.

As best shown in FIGS. 2-4, detergent dispenser 23 includes a housing 100 having a first side portion 103 and a second side portion 104. Provided on first side portion 103 is a cover 108 which extends across a rinse aid chamber 112. As depicted, cover 108 is provided with a slotted opening 114 and an enlarged opening 116, both of which open to rinse aid chamber 112. Mounted at slotted opening 114 is an elongated level indicator 118 having an upper, transparent view panel 120. On the other hand, a rinse aid knob 123 is adapted to be sealed at opening 116, such as through a bayonet-type connector 125. With this arrangement, rinse aid knob 123 can be rotated, through a limited angular range of movement, to expose rinse aid chamber 112 for filling with a rinse aid, while the level of rinse aid in rinse aid chamber 112 can be visually determined through transparent view panel 120. At the inclusion of a rinse aid in detergent dispenser 23 is known in the art and only provided here for the sake of completeness, it will not be further discussed.

More importantly, second side portion 104 of housing 100 establishes a detergent chamber 127 and a pre-wash chamber 129. A lid 132 is pivotally mounted to housing 100 for movement between an open position exposing both detergent and pre-wash chambers 127 and 129, and a closed position extending across both detergent and pre-wash chambers 127 and 129. More particularly, lid 132 is mounted through pins, one of which is shown at 135, for pivotal movement about an associated hinge axis, while being biased to the open position by a spring 137 through which pin 135 extends. When in the closed position, lid 132 is releasably secured through the use of a latch 141 having a manually engageable release portion 143, a shaft portion 145 and a latching element 146. Latch 141 is mounted to housing 100 for relative rotational movement, with shaft portion 145 extending into an aperture 147 of housing 100 with an interposed O-ring 149.

In the embodiment of FIGS. 2-4, lid 132 includes an upper or front panel 152, a pair of opposing side walls 153 and 154, and first and second end walls 155 and 156. Provided in front panel 152 of lid 132 is a series of openings 157 which are exposed to pre-wash chamber 129. In addition, projecting from a central portion (not separately labeled) of first end wall 155 is a latch member 161 which is adapted to be engaged with latch element 146 of latch 141 to retain lid 132 in the closed position. Lid 132 also includes side opening 164 for pin 135. Finally, as best shown in FIG. 2, first end wall 155 is shown to include a frontal cut-out portion 167.

Lid 132 is adapted to support an annular gasket or seal 170 defined by legs 172-175. More specifically, an interior track 177 is established on the underside of lid 132 as clearly shown in FIG. 3. Track 177 is composed of inner and outer walls 178 and 179. Annular seal 170 is positioned and retained in track 177 for use in connection with sealing at least a majority of the annular periphery of detergent chamber 127. That is, detergent chamber 127 is formed by upstanding walls 181-184. Upon the closing of lid 132, legs 172-175 of annular seal 170 abuts and seals against upstanding walls 181-184 respectively. In accordance with the invention, upstanding wall 183 of detergent chamber 127 is formed with at least one washout port. For instance, in the preferred embodiment shown in FIG. 2, a pair of washout ports 186 and 187 is spaced along upstanding wall 183 which, in turn, is directly adjacent and generally parallel to the hinge axis for lid 132. As will become more fully evident below, the particular number, location and configuration of washout ports associated with detergent chamber 127 can vary in accordance with the invention. At this point it is only important to note that, due to the presence of one or more washout ports 186, 187, there is not a complete sealing of detergent chamber 127 by seal 170, at least when lid 132 assumes an open position, either partially and fully, as will be discussed more fully below.

In further accordance with the invention, detergent dispenser 23 is also provided with a lid shield which, in the embodiment depicted in FIGS. 2-4, is indicated at 190. In the embodiment shown, lid shield 190 is formed separate from housing 100 and includes a main body 192 having an upper plateau portion 193, side legs 194 and 195, and a series of spaced support legs, such as those indicated at 196-198. With this construction, main body 192 of lid shield 190 defines a plurality of lower body slotted regions, such as those indicated at 201-203. In addition to the above structure, main body 192 of lid shield 190 includes a raised guard which is indicated at 208. In the most preferred form of the invention, guard 208 projects above upper plateau portion 193 and extends the entire length of main body 192 which, in turn, is preferably at least as long as first end wall 155 of lid 132.

When detergent dispenser 23 is fully assembled, a terminal portion (not separately labeled) of side leg 194 of lid shield 190 is fixedly received within an undercut 210 formed in cover 108. In a similar manner, a corresponding terminal portion of side leg 195 is fixedly received within a respective undercut (not labeled) formed in an adjacent portion of housing 100. This mounting between lid shield 190 and housing 300 can actually be performed in various ways known in the art, such as through the use of adhesive, welding, snap or other type of fixed connection. With this arrangement, release portion 143 of latch 141 projects from slotted region 202, with slotted regions 201 and 203 being open on either side thereof as clearly shown in FIG. 3. Actually, lid shield 190 can be attached to housing 100 in many different ways in accordance with the invention. Instead, what is relevant at this point in connection with this embodiment is that the structure and mounting establishes various passages beneath lid shield 190, with the passages being defined between the various legs 194-198, such as at slotted regions 201-203.

At the end of a washing cycle, lid 132 is typically in the fully open position shown in FIG. 4. In this condition, detergent chamber 127 can be manually filled with a desired cleansing detergent, whether in liquid or granulated form. At the same time, pre-wash chamber 129 can also be selected filled. Thereafter, lid 132 is rotated to its closed position against the biasing of spring 137 such that latch member 161 is engaged by latch element 146, whereupon seal 170 seats against upper edge portions of the upstanding walls 181-184 of detergent chamber 127.

In a manner known in the art, at a certain point in a washing cycle for dishwasher 2, latch 141 will be shifted such that lid 132 will move from the closed position toward the open position. The structure and operation of the mechanism to timely open lid 132 and dispense the housed detergent, as well as the timed release of any rinsing aid from rinse aid chamber 112, is not considered part of the present invention such that it will not be detailed herein. Instead, this structure and operation is known in the art, such as disclosed in co-owned U.S. patent application Ser. No. 11/700,005 entitled "Dispenser for a Drawer-Type Dishwasher" filed Jan. 31, 2007 and incorporated herein by reference. As indicated above, the full opening of lid 132 can be obstructed, such as by utensil 18 within utensil basket 17, or other kitchenware items including pots or pans, which become lodged across lid 132 and prevent lid 132 from properly assuming its fully open position. However, since lid shield 190 extends across housing 100 directly adjacent lid 132 and includes raised guard 208 in accordance with an aspect of the invention, any potentially obstructing kitchenware item will actually contact raised guard 208, while being spaced from lid 132 at least when lid 132 is closed and latched. Even if the kitchenware item obstructs lid 132 from moving to the full open position, the positioning and structure of lid shield 190 still assures that lid 132 will be able to at least partially open, generally in the order of about 5-15°. Even this limited degree of movement by lid 132 causes seal 170 to become unseated, particularly leg 172 from the upper periphery of wall 181. This action, in combination with the inclusion of one or more washout ports 186, 187 assures that washing fluid will be caused to enter into detergent chamber 127 and both the entering washing fluid and the contained detergent to flow out of detergent chamber 127 and into tub 5. That is, washing fluid will be permitted to flow from between lid 132 and housing 100 into detergent chamber 127 through washout ports 186 and 187 and there will be a gap, guaranteed based on the positioning and structure of lid shield 190, at first end wall 155 to enable the washing fluid and detergent to flow over wall 181. With the inclusion of the various slotted regions, such as at 201-203, the washing fluid and detergent will then be able to flow right into tub 5. In this manner, the complete flushing of detergent chamber 183 is assured.

Obviously, if not obstructed, lid 132 can fully open based on the biasing force of spring 137. Certainly, assuming the fully open position is desired for at least filling of detergent chamber 127 and/or prewash chamber 129. In accordance with the overall invention, lid 132 has a preferred range from fully closed to fully open which exceeds 180°, most preferably about 190-200° as illustrated with the angle $\alpha$ beyond the 180° mark. With this arrangement, full and complete access to detergent chamber 127 and pre-wash chamber 129 is assured for the adding of a liquid or solid detergent.

Based on the above, it should be readily apparent that the provision of one or more washout ports 186, 187 in accordance with the invention assures that detergent chamber 127 will be exposed to the flow of washing fluid needed to flush detergent from chamber 127 during a washing cycle. If no obstruction to the opening of lid 132 exists, washout ports will simple enable an increased flow rate of washing fluid into detergent chamber 127. However, if there does exist an obstruction or other reason which prevents lid 132 from fully opening, washout ports 186, 187 will still provide for a requisite amount of washing fluid flow into detergent chamber 127 is enable the proper cleaning of the kitchenware placed in dishwasher 2 for cleaning. With the inclusion of lid shield 190, and particularly guard 208 extending beyond lid 132 in the direction of opening of lid 132, lid 132 will certainly be able to open, at least to the extent needed to permit flushing of the detergent from detergent chamber 127 in combination with washout ports 186, 187. In this particular embodiment described, lid shield 190 is also advantageously structured to establish lower passages at slotted regions 201-203 to accommodate the flow of washing fluid and detergent, while also providing a recessed region for release portion 143 of latch 141.

Figure 5:
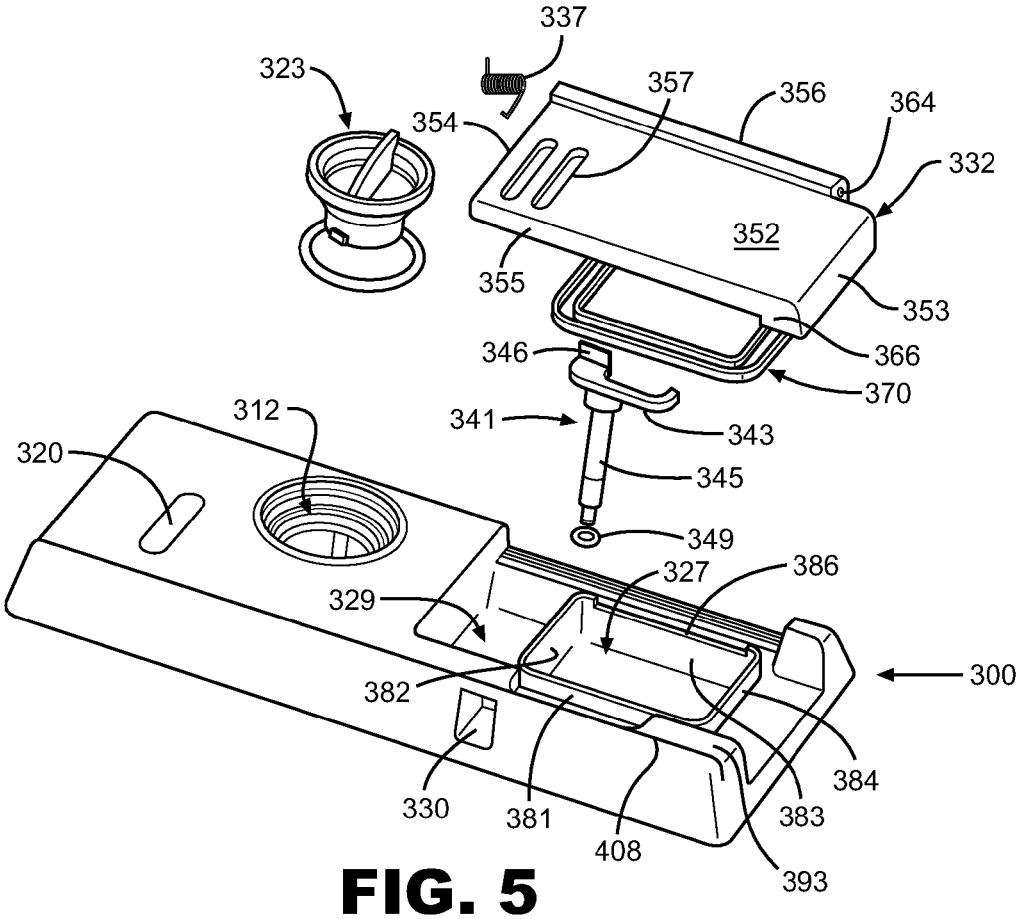
FIG. 5 is an exploded view of a detergent dispenser constructed in accordance with a second embodiment of the invention.
Figure 6:
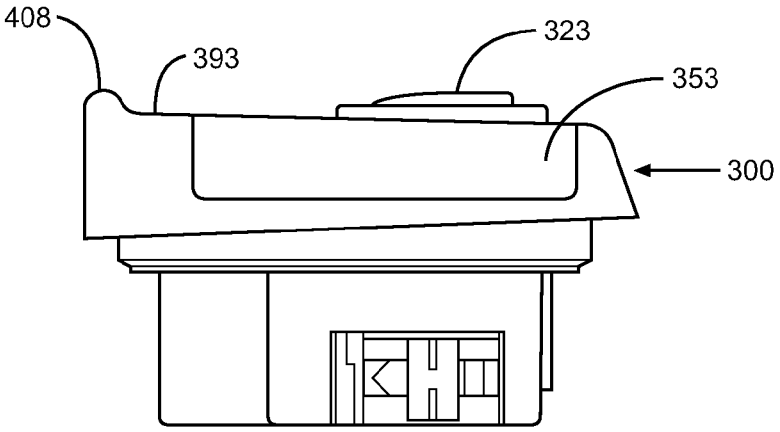
FIG. 6 is a side view of the detergent dispenser of FIG. 5.

To further illustrate the invention, FIGS. 5 and 6 will now be referenced to describe certain potential variations for a detergent dispenser constructed with the features and advantages described above. In a manner similar to the embodiment of FIGS. 2-4, these figures illustrate a dispenser assembly including a housing 300 provided on one side portion thereof with a rinse aid chamber 312 and a transparent view panel 320. Rinse aid chamber 312 can be sealed by means of a rinse aid knob 323 and an associated gasket (not labeled). In another side portion of housing 300 is formed a detergent chamber 327 and a pre-wash chamber 329. As shown, this side portion of housing 300 is also formed with an outlet port 330 which is actually open to rinse aid chamber 312 in order to provide a direct flow path into tub 5 for any rinse aid. Of course, both detergent chamber 327 and pre-wash chamber 329 are adapted to be selectively covered by a lid 332 which is biased open by means of a spring 337. As with the prior described embodiment, a latch 341, including a shaft portion 345, a manually engageable release portion 343, a latching element 346 and an associated mounting O-ring 349, is provided to releasably secure lid 332 in the closed position.

For the sake of completeness, this embodiment depicts lid 352 with an upper or front panel 352, a pair of opposing side walls 353 and 354, and first and second end walls 355 and 356. A body portion of lid 352, adjacent end wall 356, includes a side aperture 364 for pivotally mounting lid 352 to housing 300 in a manner directly corresponding to that described above. In addition, lid 352 is shown to include a series of openings 357 exposed to pre-wash chamber 329 and a down-turned portion 366 at one end of first end wall 355. Also in a manner directly corresponding to the embodiment of FIGS. 2-4, lid 352 carries a seal 370 which is designed to seat against upstanding walls 381-384 of detergent chamber 327 when lid 352 is closed. In the embodiment shown, housing 300 is formed with a recessed region (not separately labeled) directly adjacent wall 381 within which latch 341 is positioned for limited angular rotational movement between latching and release positions, with latching element 346 being adapted to interengage with a latching member (not shown) carried on the underside of lid 352 in a manner known described above and known in the art.

At this point, it should be realized that the exemplary configuration of this embodiment reinforces the notion that the actual construction of the housing, latch, lid and the like of the dispenser utilized in connection with the present invention can greatly vary. Instead, important in connection with the present invention is the inclusion of one or more washout ports associated with detergent chamber 327. In this embodiment, wall 383 of detergent chamber 327 is provided with an upper, elongated cut-out portion defining a single washout port indicated at 386. In addition, housing 300 is, in this embodiment, integrally formed with a lid shield having an associated plateau portion 393 and raised guard 408 (see both FIGS. 5 and 6).

As with the previously described embodiment, the arrangement of FIGS. 5 and 6 also advantageously ensures that even an extremely limited angular rotational release of lid 352 toward its open position will provide for a flow of washing fluid into detergent chamber 327 through washout port 386, thereby guaranteeing that detergent placed in detergent chamber 327 will be dispensed into tub 5 as needed for a proper washing cycle. This limited angular movement is defined by the minimal movement of lid 352 needed to unseat seal 370 from at least wall 381. In addition, the inclusion of raised guard 408 provides the function of spacing any obstructing kitchenware away from lid 352, at least to the extent which will still enable the limited angular movement. Of course, even in the absence of the raised guard 408, the inclusion of the washout port 386 would beneficially provide for the desired fluid flow through detergent chamber 327 unless a kitchenware item directly abutted and completely prevented lid 352 from opening an amount necessary to unseat seal 370. In any case, based on the above, it should be apparent that both of the embodiments described above provide for the inclusion of one or more washout ports for the dishwasher detergent dispenser and can also include an associated lid guard for use in combination with the washout port(s).

Although described with reference to preferred embodiments of the invention, it should be readily understood that various changes and/or modifications can be made to the invention without departing from the spirit thereof. For instance, different shield structure may be used while still performing a shielding function by protecting the dispenser from utensils, pots, pans or the like. In addition, various types of latch mechanisms may be employed to hold the lid in the closed position. Furthermore, the shield member may be constituted by a fixed member mounted to an area within the washing chamber or on the interior panel, rather than being mounted to the housing of the detergent dispenser, wherein the lid could still be protected but could pivot. Still further, the washout ports can be formed in additional ways, including providing holes or bores leading to the detergent dispenser below the lid. Finally, it should be recognized that the dispenser of the invention could be located at numerous locations and employed in various dishwasher models, including drawer dishwashers. In general, the invention is only intended to be limited by the scope of the following claims.

What is claimed is:

1. A dishwasher comprising:

a tub defining a washing chamber accommodating kitchenware to be washed with washing fluid during a washing operation; and a detergent dispenser including:

a housing mounted within the dishwasher and exposed to the tub, said housing defining a detergent chamber for receiving detergent to be dispensed into the tub during the washing operation and being provided with at least one washout port opening into the detergent chamber;

a lid mounted for movement between a closed position in which the detergent chamber is covered and an open position in which the detergent chamber is exposed;

a latch for releasably retaining the lid in the closed position; and a shield member spaced from and extending across at least a portion of the lid to prevent the lid from being obstructed by kitchenware in the washing chamber, with the shield member enabling the lid to assume at least a partially open position between the closed and open positions during the washing operation and the at least one washout port configured to enable washing fluid to enter the detergent chamber through the at least one washout port to flush detergent from the detergent chamber;

wherein the shield member is coupled to the housing such that the shield member does not move relative thereto.

2. The dishwasher according to claim 1, wherein the at least one washout port is located below the lid.

3. The dishwasher according to claim 2, wherein the detergent chamber is defined by a plurality of upstanding walls, the at least one washout port being formed in one of the plurality of upstanding walls.

4. The dishwasher according to claim 3, wherein the at least one washout port being defined by a cut-out formed in the one of the plurality of upstanding walls.

5. The dishwasher according to claim 4, wherein the at least one washout port is defined by a pair of spaced cut-outs formed in one of the plurality of upstanding walls.

6. The dishwasher according to claim 3, further comprising a seal mounted to an underside of the lid, said seal being seated against the plurality of upstanding walls when the lid is in the closed position, said seal becoming unseated from another one of the plurality of upstanding walls when the lid assumes the partially open position.

7. The dishwasher according to claim 6, wherein the another one of the plurality of upstanding walls is arranged opposite the one of the plurality of upstanding walls formed with the at least one washout port.

8. The dishwasher according to claim 2, wherein the lid is pivotally mounted for movement about a hinge axis between the open and closed positions, said at least one washout port being arranged directly adjacent the hinge axis.

9. The dishwasher according to claim 8, wherein the lid is pivoted from the closed position to the open position through an angle greater than 180°.

10. The dishwasher according to claim 9, further comprising a spring biasing the lid to rotate about the hinge axis to the open position.

11. The dishwasher according to claim 1, wherein the shield member includes a guard, which is spaced from the lid, extends along the lid and projects beyond the lid, for preventing kitchenware from obstructing the movement of the lid to at least the partially open position.

12. The dishwasher according to claim 11, wherein the shield member includes a plateau portion from which the guard projects.

13. The dishwasher according to claim 11, wherein the shield member is supported from the housing by a plurality of legs which are spaced to define slotted regions through which washing fluid can flow.

14. The dishwasher according to claim 13, wherein the latch includes a manual release portion which projects through one of the slotted regions.

15. The dishwasher according to claim 11, wherein the guard is integrally formed with the housing.

16. A dishwasher comprising:

a tub defining a washing chamber accommodating kitchenware to be washed with washing fluid during a washing operation; and a detergent dispenser including:

a housing mounted within the dishwasher and exposed to the tub, said housing defining a detergent chamber for receiving detergent to be dispensed into the tub during the washing operation and being provided with at least one washout port opening into the detergent chamber;

a lid mounted for movement between a closed position in which the detergent chamber is covered and an open position in which the detergent chamber is exposed;

a latch for releasably retaining the lid in the closed position; and a shield member spaced from and extending across at least a portion of the lid to prevent the lid from being obstructed by kitchenware in the washing chamber, with the shield member enabling the lid to assume at least a partially open position between the closed and open positions during the washing operation and the at least one washout port configured to enable washing fluid to enter the detergent chamber through the at least one washout port to flush detergent from the detergent chamber;

wherein the lid further has a hinge axis, the shield member being coupled to the housing at a position opposite the hinge axis of the lid and supported from the housing by a plurality of legs which define slotted regions through which washing fluid can flow from the at least one washout port.

17. The dishwasher according to claim 16, wherein the shield member further has a first end and a second end, a first leg of the plurality of legs being located between the first end and the second end.

18. The dishwasher according to claim 17, wherein the shield member further has a longitudinal axis running between the first end and the second end that divides the shield member into a front portion and a rear portion, with the first leg being located in the front portion and a second leg of the plurality of legs being located in the rear portion.

19. The dishwasher according to claim 18, wherein the shield member further has third and fourth legs of the plurality of legs, the third leg being located at the first end of the shield member and the fourth leg being located at the second end of the shield member.

20. The dishwasher according to claim 16, wherein the plurality of legs includes at least three spaced legs, the at least three spaced legs defining the slotted regions.

* * * * *